US005249635A

United States Patent [19]

King et al.

[11] Patent Number: 5,249,635

[45] Date of Patent: Oct. 5, 1993

[54] METHOD OF AERATING DRILLING FLUID

[75] Inventors: Charles W. King, Tunis, Tunisia; Bruce W. Caddy, Lafayette, La.

[73] Assignee: Marathon Oil Company, Finlay, Ohio

[21] Appl. No.: 876,949

[22] Filed: May 1, 1992

[51] Int. Cl.[5] ..... E21B 21/08; E21B 47/00; E21B 47/06

[52] U.S. Cl. ..... 175/48; 175/69

[58] Field of Search ..... 175/38, 48, 68, 69, 175/71

[56] References Cited

U.S. PATENT DOCUMENTS

| | | | |
|---|---|---|---|
| 2,818,230 | 12/1957 | Davis . | |
| 2,880,965 | 4/1959 | Bobo | 175/69 |
| 3,308,894 | 3/1967 | Reinhart | 175/68 |
| 3,497,020 | 2/1970 | Kammerer, Jr. | 175/69 |
| 3,534,822 | 10/1970 | Campbell et al. | 175/69 |
| 3,603,409 | 9/1971 | Watkins | 175/7 |
| 4,091,881 | 5/1978 | Maus | 175/48 X |
| 4,155,410 | 5/1979 | Jackson | 175/66 |
| 4,394,880 | 7/1983 | Faulkner | 175/69 |
| 4,867,254 | 9/1989 | Gauignet | 175/48 |

*Primary Examiner*—George A. Suchfield

*Attorney, Agent, or Firm*—Jack L. Hummel; Jack E. Ebel

[57] ABSTRACT

A method of maintaining a constant predetermined hydrostatic pressure in a wellbore being drilled by a rotary drilling process utilizing aerated drilling fluid. The aerating gas, such as compressed air, is maintained at a constant pressure while its flow is changed in response to changes in the flow of the drilling fluid. This maintains a constant ratio of compressed air to drilling fluid, resulting in the hydrostatic pressure remaining constant.

12 Claims, 2 Drawing Sheets

METHOD OF AERATING DRILLING FLUID

FIELD OF THE INVENTION

This invention relates to the aerating of drilling fluid used in the drilling of a well bore. More particularly, it relates to a method of injecting air and drilling fluid into a drill string so as to maintain a predetermined hydrostatic pressure in the well bore.

BACKGROUND OF THE INVENTION

In the rotary drilling of oil wells, drilling fluid is introduced to the drilling area through the drill string for several reasons. It cools and lubricates the drill bit at the bottom of the drill string and carries the cuttings to the surface through the annular space between the drill pipe and the wall of the well bore. Fluid in the annulus also provides a static head which assists in maintaining the hydrostatic pressure in the well bore greater than the formation pressure, thereby preventing the intrusion of gas or liquid from a subterranean zone containing formation fluids.

Although drilling fluid provides these beneficial results, it can also be the cause of potential problems. If the difference between the hydrostatic pressure and the formation pressure is great enough, drilling fluid will tend to flow into intersected permeable formations. It is not only expensive to lose this drilling fluid, but if the amount of fluid flowing into the formation results in the loss of circulation of the drilling fluid, the drill bit may bind and the well bore may collapse. Moreover, drilling fluids lost in the formation can plug the formation, eventually resulting in less production from the well.

One way of preventing or controlling the loss of drilling fluid is to aerate the fluid. It has been recognized that by reducing the density of the fluid the hydrostatic pressure exerted by the column of drilling fluid in the well bore is also reduced. By controlling the hydrostatic pressure the amount of fluid lost in permeable formations can be minimized, making the process less costly and making it less likely that the fluid will plug adjacent formations or that fluid circulation will be lost. Typically, the amount of air to be included in the drilling fluid in any particular drilling operation is determined, and air compressors are provided to deliver that amount into either the drilling fluid discharge line or the drilling fluid return line. In either case, injection of air into the drilling fluid at a fixed rate can result in fluctuation of the hydrostatic pressure of the fluid in the well bore as operating conditions change. For example, fluctuations in pump speed, drilling fluid volumes, injection pressures and weight on the drill bit can cause pressure variances downhole, resulting in variances in the ratio of air to drilling fluid and consequent variances in density and hydrostatic pressure.

In order to overcome these problems, it is an object of the invention to provide an aeration system which is able to control the flow of compressed air into the drill string so as to automatically maintain a constant hydrostatic pressure in the well bore.

BRIEF SUMMARY OF THE INVENTION

In accordance with the invention, drilling fluid pumped into the drill pipe of a rotary drilling operation is monitored, and the flow of aerating gas is correlated with the monitored flow of the drilling fluid. In this manner the ratio of the amount of aerating gas injected into the drilling fluid to the amount of drilling fluid pumped into the drill pipe is maintained substantially constant. As a result, the hydrostatic pressure of the aerated fluid in the wellbore remains substantially constant at the desired predetermined pressure. In addition, the pressure of the aerating gas is maintained at a constant level.

Preferably, the flow of aerating gas is controlled by a flow control valve and data from the monitoring of the flow of drilling fluid is transmitted to the flow control valve by suitable means such as a control relay. Also, monitoring of the flow of drilling fluid is preferably carried out by a liquid flow transmitter. The aerating gas preferably is compressed air.

Apparatus for carrying out the invention is readily available and can easily be assembled onto a skid, which can be transported to field sites as needed. The method is simple and economical, yet highly efficient.

These and other features and aspects of the invention, as well as other benefits, will readily be ascertained from the more detailed description of the preferred embodiment below.

DETAILED DESCRIPTION OF THE PREFERRED EMBODIMENT

Figure 1:
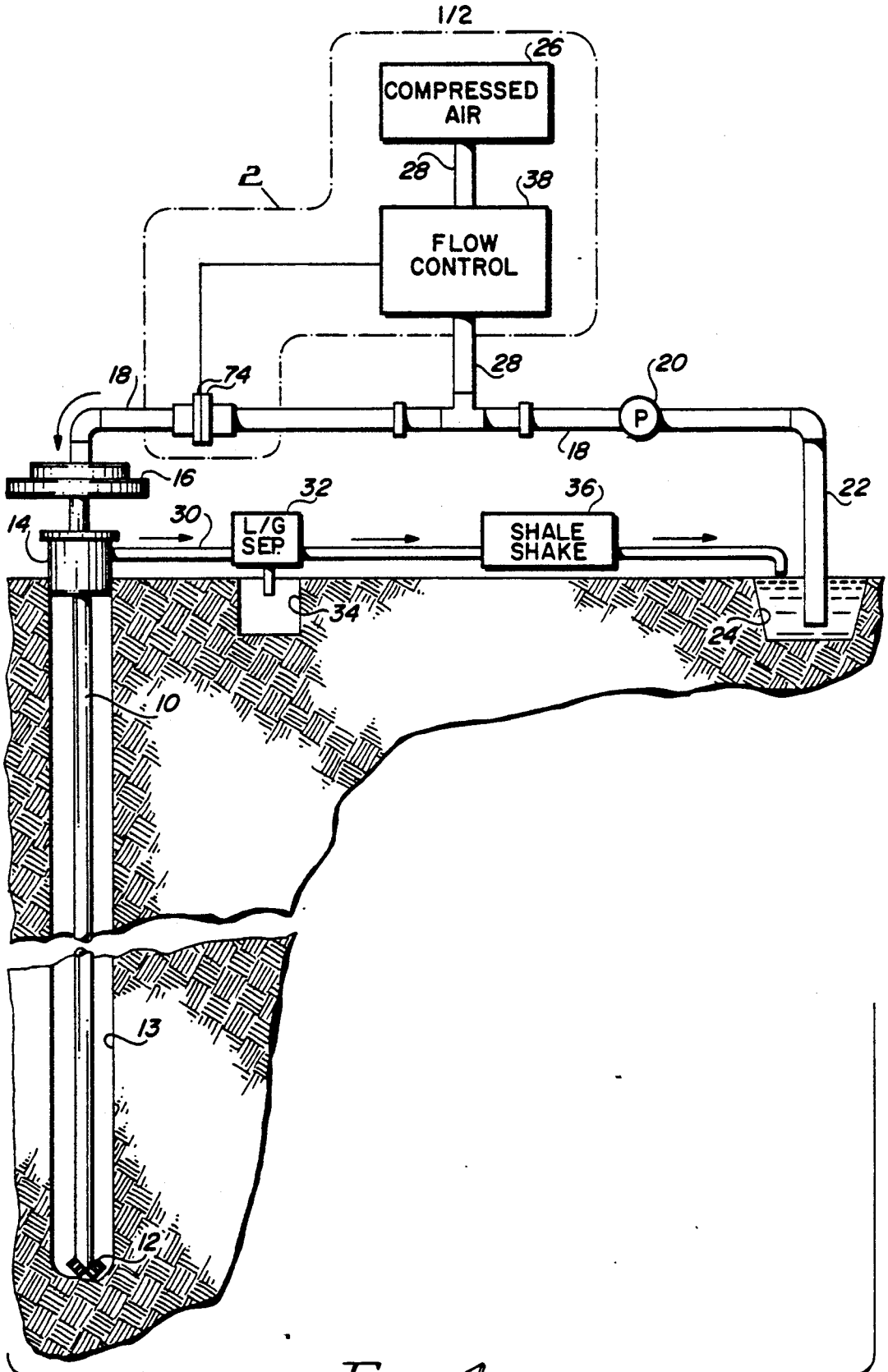
FIG. 1 is a schematic view, shown partially in transverse section, of a simplified well drilling arrangement incorporating the invention.

Referring to FIG. 1, a simplified typical well drilling arrangement is illustrated which employs a drill string 10 having a drill bit 12 at the lower end. The well bore 13 produced by the drilling operation is illustrated as extending a substantial distance below the surface. The drill string extends up through well head 14 to a rotary table 16 by means of which the drill string is rotated. Connected to the drill pipe is a conduit 18 extending from the discharge side of pump 20. An intake conduit 22 connects the pump 20 to pit 24, which is the source of drilling fluid, sometimes also referred to herein as drilling mud. A source of compressed air 26 is connected by line 28 to the conduit 18 to allow compressed air to be mixed with the drilling fluid in conduit 18 prior to being introduced to the drill pipe 10.

The process described thus far functions in the usual manner, with cuttings from the drill bit being carried up to the surface through the annular space between the drill string 10 and the well bore 13 by drilling fluid introduced from the lower end of the drill string. This recirculated drilling fluid is delivered through a return line 30 extending from the well head to the mud pit 24. As illustrated, the drilling fluid in the return line 30 may be further treated by subjecting it to the action of a liquid/gas separator 32 to separate the liquid and gas constituents of the fluid, with the gas typically being delivered to a flare pit 34 and the liquid being delivered to the pit 24 via a shale shaker 36. It will be understood that because the further treatment of the recycled drilling fluid does not form a part of the present invention the details of such treatment steps are not described. It should also be understood that although only a single mud pit 24, pump 20 and air compressor 26 have been shown for the sake of convenience, the process may include as many of these elements as may be necessary to handle the required volumes of materials.

In addition to the arrangement described thus far, the invention provides control means 38 connected to the air injection line 28 for the purpose of controlling the flow of compressed air to the drilling fluid. This is shown in more detail in FIG. 2, wherein the pressure in the line 28 is controlled by back pressure valve 40, which communicates with the air line 28 by means of the short conduit 42. The pressure at which the back pressure valve 40 operates is controlled by back pressure controller 44, which is in communication with the air in conduit 28 and is located downstream from the conduit 42. The controller, which is electrically connected to the back pressure valve 40 as indicated by the dotted line 46, may be any suitable type capable of maintaining the proper amount of pressure on the valve. Model 4160 R produced by Fisher Corporation has been found to perform adequately for this purpose.

Should the air pressure in line 28 be too high the back pressure valve will open and air will flow through pressure relief valve 48 and conduit 50 to the flare pit 34 shown in FIG. 1. Valve 52, which is located in the short fluid line 54 connecting the conduits 28 and 50 and which is normally closed, allows air to be diverted directly from the air compressor to the flare pit when open. The valves 56 and 58, which are in the conduit 28 upstream and downstream of the line 42, are normally open, but can be closed, in the case of valve 56 when diverting air to the flare pit, and in the case of valve 58 when diverting air through the back pressure valve 40.

Downstream from the back pressure controller is an air or gas controller 60 which is in communication with the air in line 28. The controller 60 is electrically connected by lines 62 and 64 and set point control relay 66 to flow control valve 68 located further downstream in the line 28. The set point control relay 66 is also connected by electrical line 70 to liquid flow transmitter 72 which monitors the flow of drilling fluid at the drilling fluid orifice flanges 74 in conduit 18 through fluid lines 76 and inputs this information to the control relay 66. As in the case of the back pressure controller, the air or gas controller 60 and the liquid flow transmitter 72 may be of any suitable design capable of carrying out the intended function. Examples of such instruments are model 335A air or gas controller and model 385A liquid flow transmitter manufactured by Barton Corporation. Although not illustrated, a chart recorder as well as pressure and time gauges may be connected to the gas conduit 28 for the purpose of visual monitoring and preparation of a permanent record of flow conditions.

In operation, the desired density of the drilling fluid is determined for the drilling operation in question, and the ratio of air to fluid in order to yield that density is computed by means well known in the industry. Knowing the pumping rate of the drilling fluid pump 20, the air compressor is set to deliver compressed air at the pressure that will produce the desired ratio. Because pressure will vary during drilling, the pressure of the compressed air is controlled by the back pressure valve 40 and flow is controlled by flow control valve 68. This arrangement keeps the flow stable as the pressure varies. The liquid flow transmitter 72 monitors the amount of drilling fluid being pumped into the drill pipe. As the flow of drilling fluid decreases or increases the air injection flow will decrease or increase a corresponding amount. This occurs as a result of the set point control relay controlling the flow control valve 68 in response to input from the liquid flow transmitter 72. Thus if the drilling fluid pump rate increases or decreases, the air injection rate automatically changes a corresponding amount so that compressed air is injected into the drilling fluid stream in the proper amount to maintain a constant hydrostatic pressure in the bore hole.

Figure 2:
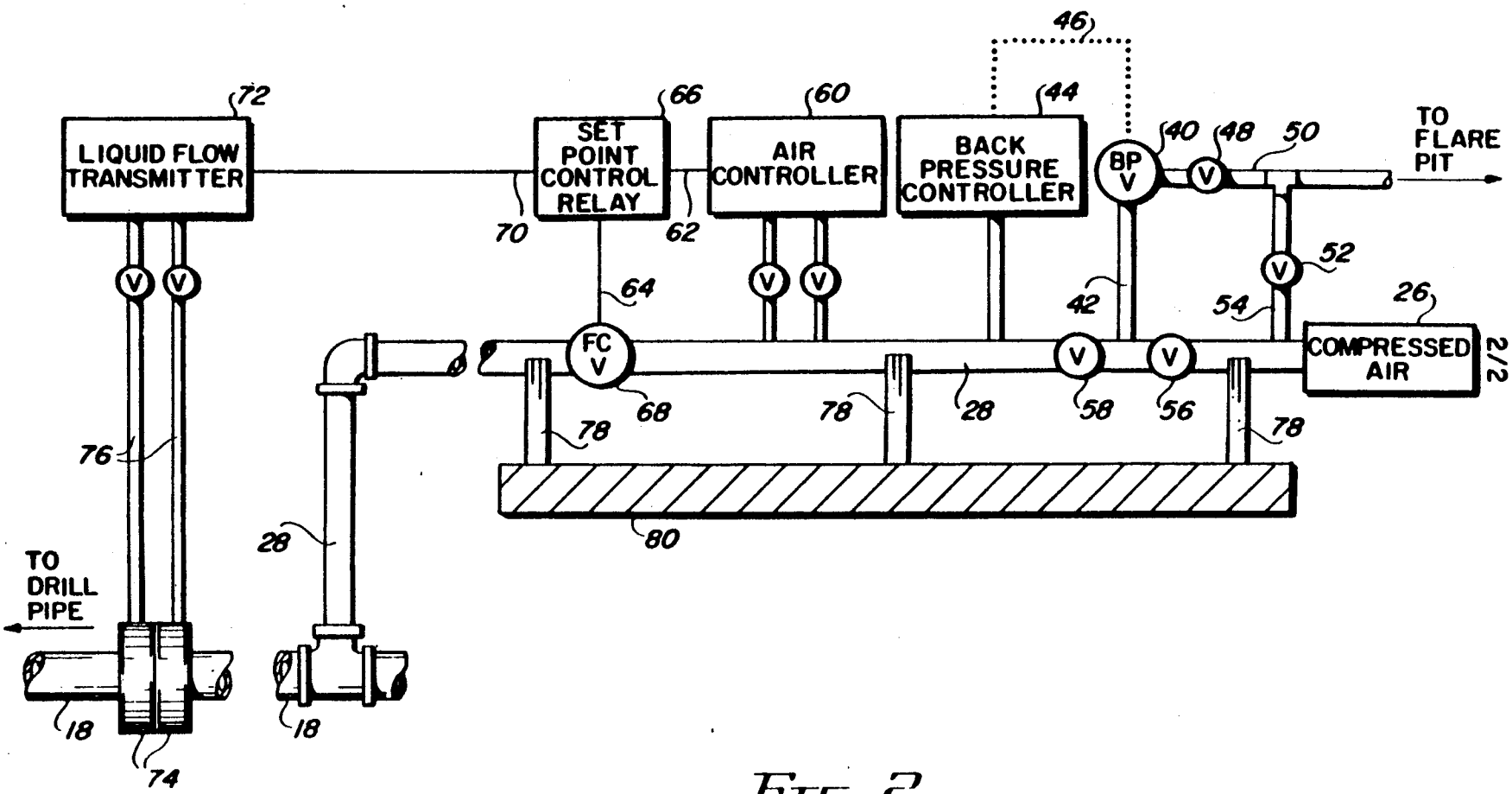
FIG. 2 is a simplified schematic view of the control means located within the boundary 2 of FIG. 1 for maintaining a constant hydrostatic head in the wellbore.

The flow control arrangement of the invention can be mounted on a skid and transported to the borehole site, where it is a simple matter to connect it to the usual piping. For this purpose, the conduit 28 is shown in FIG. 2 as being mounted on spaced supports 78 attached to base support 80.

The invention is not limited to use with any particular type of drilling fluid since the method will work in connection with any drilling fluid capable of functioning when aerated and whose flow can be monitored by the liquid flow transmitter. Although air has been referred to in the description of the aerating process of the invention, it will be understood that other gases may instead be combined with the drilling fluid, if desired, in accordance with the invention. Because of its ready availability, low cost and good performance, however, air is the preferred gas.

It should be understood that the invention is not necessarily limited to the specific details described in connection with the preferred embodiment, and that changes to certain features and aspects thereof which do not affect the overall basic function and concept of the invention may be made by those skilled in the art without departing from the spirit and scope of the invention, as defined in the appended claims.

What is claimed is:

1. A method of aerating drilling fluid used in the drilling of a wellbore in order to maintain a predetermined hydrostatic pressure in the wellbore, comprising the steps of:

pumping drilling fluid into a drill pipe;

injecting aerating gas into the drilling fluid;

monitoring the flow of drilling fluid; and controlling the flow of the aerating gas in accordance with the flow of the drilling fluid as determined by the monitoring step;

whereby the ratio of the amount of aerating gas injected into the drilling fluid to the amount of drilling fluid pumped into the drill pipe is substantially constant.

2. The method of claim 1, wherein the flow of aerating gas is controlled by a flow control, valve.

3. The method of claim 2, wherein data from the monitoring of the flow of drilling fluid is transmitted to means for controlling the flow control valve.

4. The method of claim 3, wherein the means for controlling the flow control valve comprises a control relay.

5. The method of claim 4, wherein monitoring of the flow of drilling fluid is carried out by a liquid flow transmitter.

6. The method of claim 1, including the step of maintaining the pressure of the aerating gas substantially constant.

7. The method of claim 6, wherein the pressure of the aerating gas is maintained substantially constant by means of a back pressure control valve.

8. The method of claim 1, wherein the aerating gas is air.

9. The method of claim 1, wherein the aerating gas is injected into the drilling fluid prior to the drilling fluid being introduced into the drill pipe.

10. A method of maintaining a predetermined hydrostatic pressure in a wellbore being drilled by a rotary drill string into which aerated drilling fluid is supplied, comprising the steps of:

pumping drilling fluid into the drill string;

monitoring the flow of drilling fluid;

injecting aerating gas into the drilling fluid;

controlling the pressure of the aerating gas to maintain said pressure substantially constant; and controlling the flow of the aerating gas by increasing or decreasing the flow in accordance with any increase or decrease in the flow of the drilling fluid as determined by the monitoring step so as to maintain the ratio of the amount of aerating gas injected into the drilling fluid to the amount of drilling fluid pumped into the drill string substantially constant.

11. The method of claim 10, wherein the flow of aerating gas is controlled by a flow control valve and wherein data from the monitoring of the flow of drilling fluid is transmitted to means for controlling the flow control valve.

12. The method of claim 11, wherein the means for controlling the flow control valve comprises a control relay and wherein monitoring of the flow of drilling fluid is carried out by a liquid flow transmitter.

* * * * *